US007163410B2

(12) United States Patent
Isaacks

(10) Patent No.: US 7,163,410 B2
(45) Date of Patent: Jan. 16, 2007

(54) SECURE CABLE SYSTEM

(75) Inventor: Scott J. Isaacks, Seattle, WA (US)

(73) Assignee: Zephyr Communications, Inc., Seattle, WA (US)

( * ) Notice: Subject to any disclaimer, the term of this patent is extended or adjusted under 35 U.S.C. 154(b) by 0 days.

(21) Appl. No.: 10/989,986

(22) Filed: Nov. 16, 2004

(65) Prior Publication Data

US 2005/0164535 A1 Jul. 28, 2005

(51) Int. Cl.
*H01R 13/44* (2006.01)

(52) U.S. Cl. ..... 439/133; 174/48; 191/12.4

(58) Field of Classification Search ..... 439/133; 174/48; 191/12.4
See application file for complete search history.

(56) References Cited

U.S. PATENT DOCUMENTS 4,381,063 A * 4/1983 Leong ..... 220/242
4,596,095 A * 6/1986 Chalfant ..... 52/126.6
5,057,647 A * 10/1991 Bogden et al. ..... 174/48
5,285,009 A * 2/1994 Bowman et al. ..... 174/48
6,102,229 A * 8/2000 Moncourtois ..... 220/3.3

OTHER PUBLICATIONS

National Security Telecommunications and Information Systems Security Instruction (NSTISSI No. 7003). Dec. 13, 1996. "Protective Distribution Systems (PDS)." 13 pp. See pp. 7-8 (Annex B) specifically.

SMED International. nd. "Stay on top of your technology." 28 pp.

Notification of Transmittal of the International Search Report and the Written Opinion of the International Searching Authority, or the Declaration; Feb. 27, 2006, 7 pages.

* cited by examiner

*Primary Examiner*—Truc Nguyen
(74) *Attorney, Agent, or Firm*—Darby & Darby P.C.; Thomas R. Marquis

(57) ABSTRACT

Secure cable connections in a structure. Cables are routed between a fixed surface and a removable surface to connectors within a lockable enclosure. Removable surfaces include raised floors, suspended ceilings, and the like that generally comprise tiles for access to an area between the removable surface and the fixed surface. Cable connectors are coupled to distribution panels, distribution cassettes, individual jacks, and/or other connectors within the lockable enclosure, which prevent unauthorized access to the cable connections. Cables are prefabricated to desired lengths with color coding and/or keyed connectors. Distribution cassettes, panels, jacks, and/or other connectors are also prefabricated with matching colors and/or keyed connectors to minimize installation time and connection errors. Lockable enclosures include concealed enclosures behind removable surfaces, integrated enclosures within removable surfaces, wall outlets, furniture outlets, and the like. The enclosures generally include a lockable door and openings that prevent access to, and/or removal of cable connectors.

7 Claims, 9 Drawing Sheets

FIG. 8A
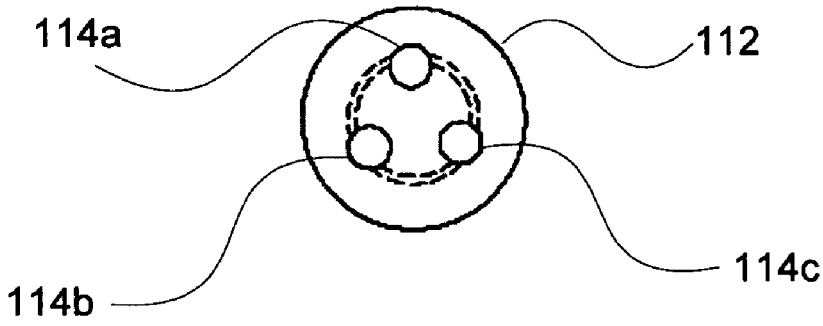
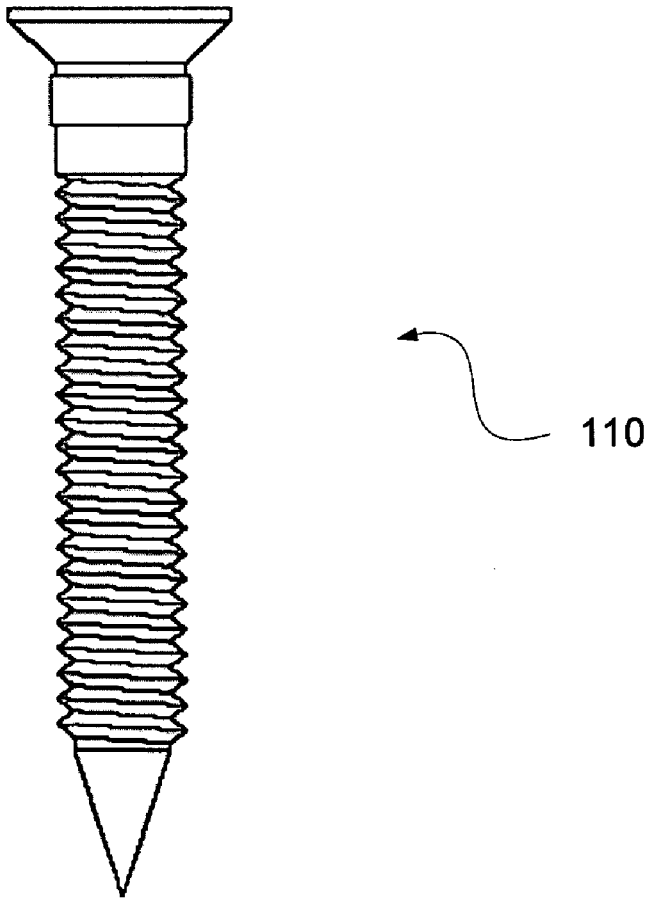
FIG. 8B

SECURE CABLE SYSTEM

FIELD OF THE INVENTION

The present invention is directed to a secure cabling system, and more specifically to a modular cabling system with secure junctions.

BACKGROUND OF THE INVENTION

Security concerns have grown in recent years, including concerns over infrastructure security. Data and communication infrastructures have increased in importance as more individuals, businesses, and government organizations increase reliance on these infrastructures. Consequently, security for data and communication infrastructures has grown in importance. One substantial aspect of these infrastructures is the cabling and connections needed to form networks and other communication pathways.

Cabling systems in buildings are typically installed above suspended ceilings or below raised floors. Often, cables are simply routed on the framework of suspended ceilings and/or on the subfloor below raised floors. Some cables may be routed in raceways or conduits to better organize the routes and/or to aesthetically route cables within the space between the ceiling and floor. Distribution boxes and panels may also be used to subdivide large trunk lines into smaller branch lines that may be further subdivided and/or connected to computing and/or communication devices. To enable easy reconfiguration of the cabling, individual tiles of suspended ceilings and/or raised floors can be removed to access the cables and/or the distribution boxes. This easy access can create a security issue.

BRIEF DESCRIPTION OF THE DRAWINGS

FIG. 8A is a top view of an exemplary security fastener; and

FIG. 8B is a front view of the exemplary security fastener.

DETAILED DESCRIPTION OF THE INVENTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the following detailed description is, therefore, not to be taken in a limiting sense.

Throughout the specification, the term "connected" means a direct connection between the things that are connected, without any intermediary devices or components. The term "coupled," means a direct connection between the things that are connected, or an indirect connection through one or more either passive or active intermediary devices or components. The term "cable" and "line" mean a communication medium. The meaning of "a," "an," and "the" include plural references. The meaning of "in" includes "in" and "on."

Figure 1:
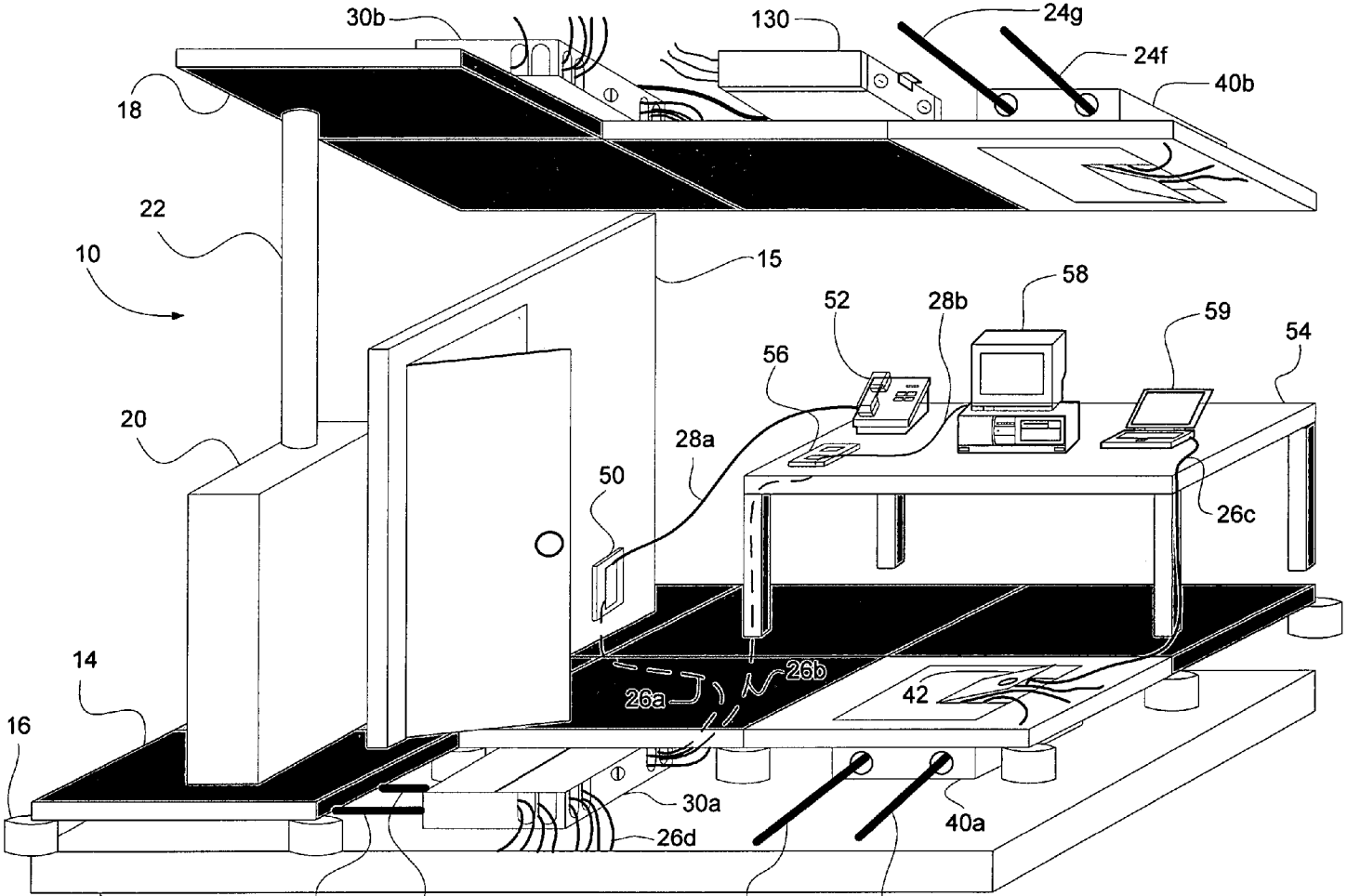
FIG. 1 illustrates an exemplary embodiment for securing communication cable connections in floor and/or ceiling spaces of a building interior space.

Briefly stated, the invention is direct to securing cable connections such as communication connections and/or electrical connections. FIG. 1 illustrates an exemplary embodiment for securing communication cable connections in floor and/or ceiling spaces of an internal space of a structure, such as a building interior space 10. A floor space is created between a fixed floor 12 and a removable tile floor 14. The removable tiles are supported above fixed floor 12 by floor supports such as floor support 16 at the corner of each tile. Other supports can be used along tile edges and/or central portions of the tiles. In this exemplary embodiment, each floor tile is fastened to one or more floor supports, although the tile need not be fastened. To further prevent access to the floor space, the tiles can be secured to the floor supports with security fasteners that can not be removed with a conventional tool such as a flat head screwdriver, a phillips head screwdriver, an allen wrench, a socket wrench or other conventional fastener tool. An exemplary security fastener is illustrated in FIGS. 8A and 8B. Security fasteners can also be used for attaching other components described below. The floor tiles can be covered by carpet tiles and/or other floor coverings. A similar configuration is provided for a ceiling space of building interior space 10. A suspended ceiling 18 generally comprises a set of ceiling tiles supported by a framework that is supported from a fixed ceiling (not explicitly shown).

A communication distribution panel 20 is generally secured in a locked room or other space. Communication cables are routed into the floor space and/or into the ceiling space. A conduit 22 and/or raceways can be used to control routing. Trunk lines, such as trunk lines 24*a* through 24*f*, are routed in the floor space and/or ceiling space from communication distribution panel 20 to distribution boxes, such as concealed distribution boxes 30*a*, and 30*b*, and/or 130. Trunk lines can also be routed to distribution boxes or outlets, such as integrated distribution boxes 40*a* and 40*b*, that pass through a hole in a floor, ceiling, wall, furniture, or other surface. The trunk lines can be prefabricated to predefined lengths and can be color coded for different communication protocols and/or purposes. The trunk lines can also be prefabricated with keyed connectors on one or both ends of each trunk line to prevent connection errors during installation. The types of connectors include RJ45 connectors, SMA connectors, FC connectors, ST connectors, twist-lock connectors, and the like. Alternatively, or in addition, a trunk line can be coupled to a distribution cassette (not show) that splits the trunk line into multiple branch line connections.

The distribution cassette, connector, and/or bare wire ends are installed inside a distribution box. A concealed distribution box can be accessed by removing a floor tile or a ceiling tile, respectively. An integrated distribution box extends at least partially through a floor tile and/or a ceiling tile such that the integrated distribution box is accessible without removing an entire tile. An integrated distribution box can be flush with a tile surface, recessed below a tile surface, or extend beyond a tile surface. In any case, locking mechanisms on the concealed and integrated distribution boxes prevent access to an interior cavity of the distribution boxes where the cassettes, connectors, and/or bare wires ends are located.

Additional trunk lines and/or branch lines, such as branch lines 26*a*–26*d*, can be extended from the distribution boxes to other parts of the building interior. For example, branch line 26*a* can be routed under the raised floor, up into a wall 15, and coupled to a wall outlet 50. Wall outlet 50 can include a locking mechanism to prevent access to branch line 26*a* and/or to prevent access to an end of a device cable 28*a* that is connected to a communication device, such as telephone 52. Another branch line 26*b* can be routed under the raised floor and directly into a piece of furniture 54 to a furniture outlet 56. Furniture outlet 56 can also include a locking mechanism to prevent access to branch line 26*b* and/or to prevent access to an end of another device cable 28*b*, which is illustrated connected to a computer 58. Alternatively, or in addition, a branch line 26*c* can be routed directly out of an integrated distribution box, such as out of door 42 of integrated distribution box 40*a*. Door 42 includes a locking mechanism to prevent access to connections within integrated distribution box 40*a*. Door 42 also prevents removal of branch line 26*c*, which is shown connected to a portable computer 59. As illustrated, branch lines can also be routed above ceiling tiles and/or dropped down to devices with or without conduits.

Figure 2:
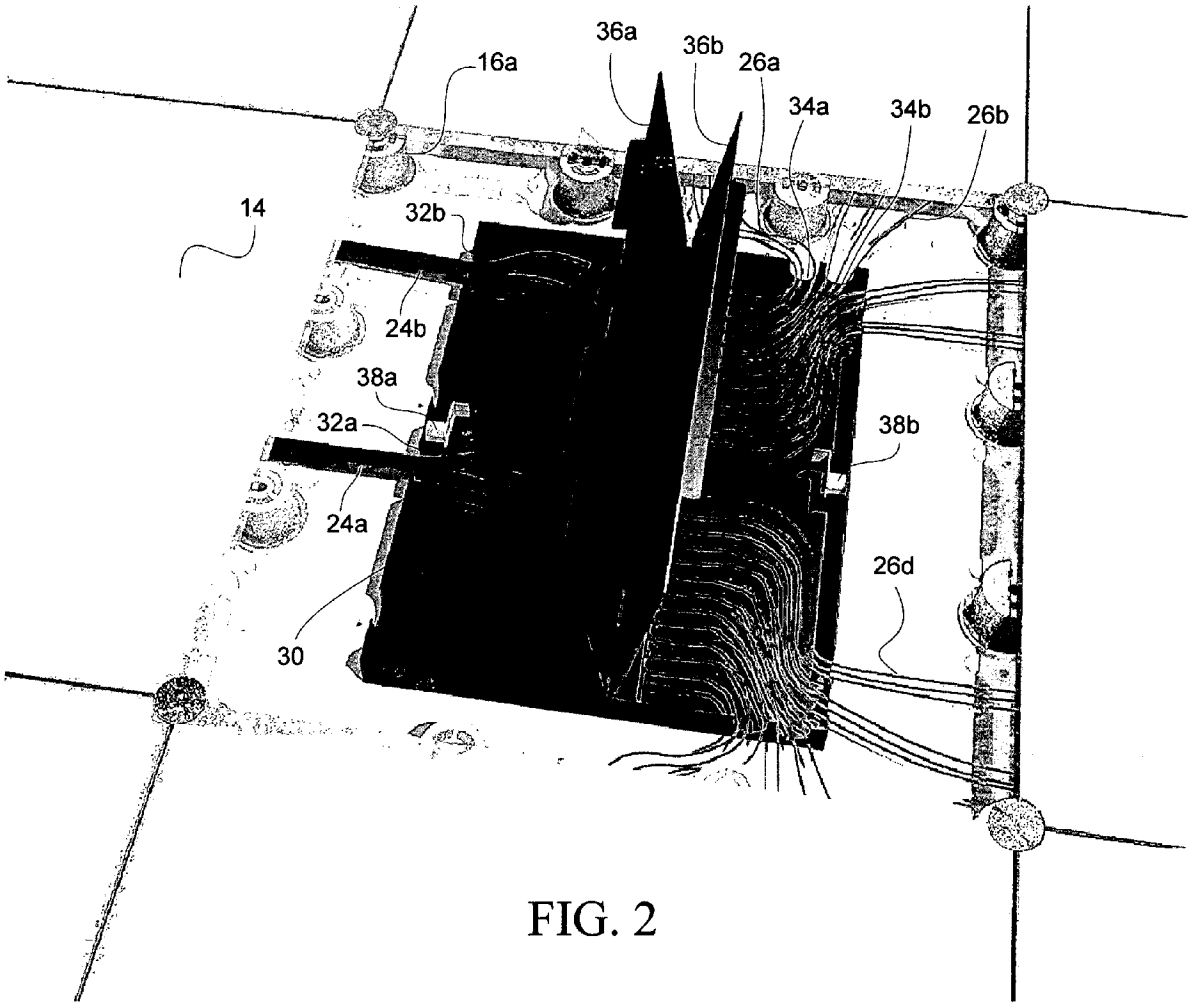
FIG. 2 illustrates an exemplary embodiment of a concealed distribution box installed below raised floor with one floor tile removed.

FIG. 2 illustrates an exemplary embodiment of concealed distribution box 30 installed below raised floor 14 with one floor tile removed. Trunk lines, such as trunk lines 24*a* and 24*b*, are routed through trunk openings 32*a* and 32*b*, respectively, of the concealed distribution box. Similarly, branch lines, such as branch lines 26*a*, 26*b*, and 26*d*, are routed through branch openings, such as branch openings 34*a* and 34*b*. Connectors of the trunk lines and the branch lines are accessible via doors 36*a* and 36*b*, respectively. The doors are lockable with locking mechanisms 38*a* and 38*b*, respectively. Each lock can be keyed differently. The different keying can be done individually or by security classification (e.g., top secret classification versus secret classification), or both. Other locking mechanisms can include pad locks, and the like.

Figure 3:
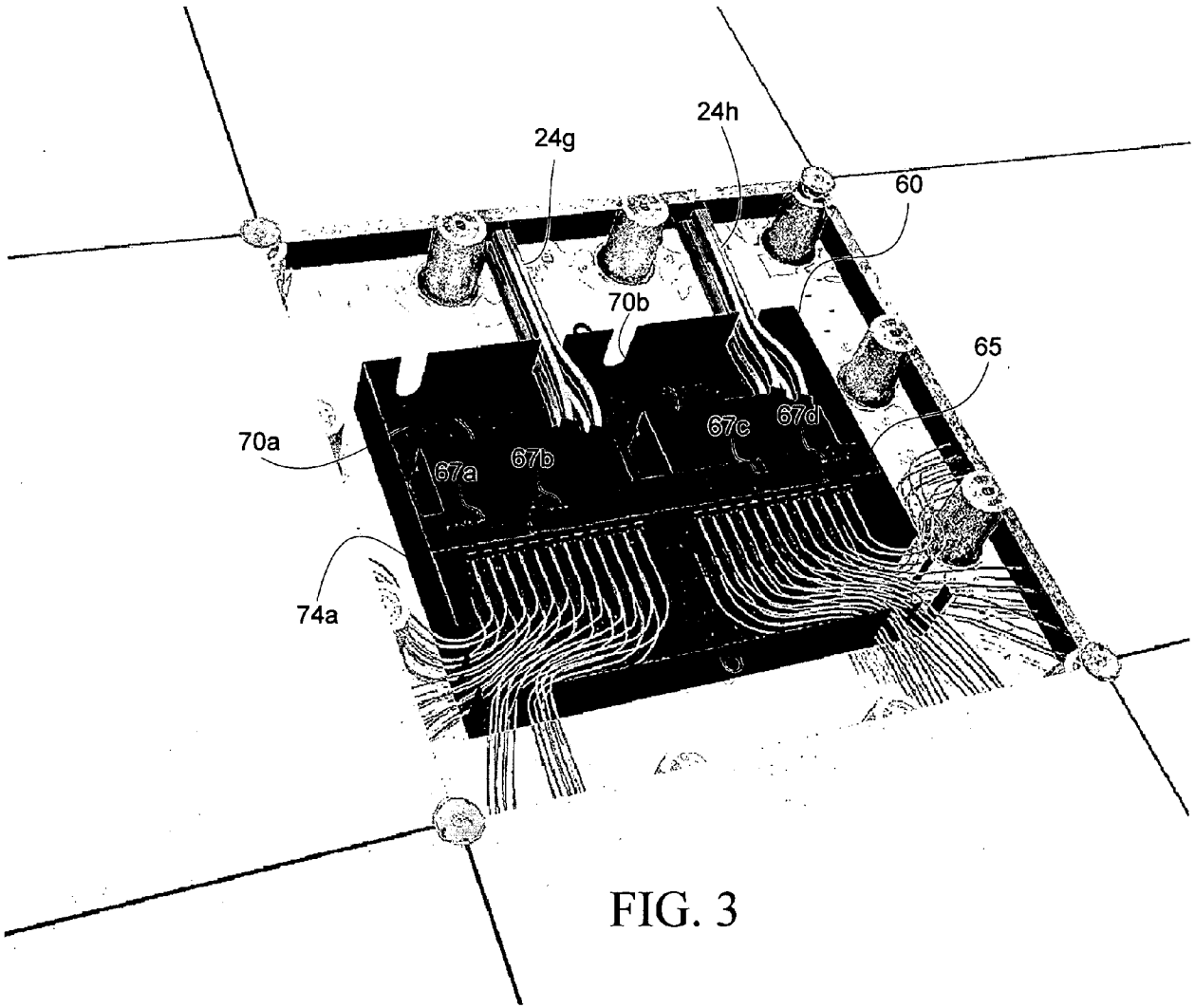
FIG. 3 illustrates an exemplary embodiment of a double height concealed distribution box installed below a raised floor with one floor tile removed.

FIG. 3 illustrates an exemplary embodiment of a double height concealed distribution box installed below raised floor 14 with one floor tile removed. The doors of the distribution box are also removed, providing easier visibility of the internal portion of a multi-sided housing 60. In this view, it is easier to see that connectors on trunk lines 24*g* and 24*h* are connected to distribution cassettes 70*a* and 70*b*, respectively. The distribution cassettes distribute trunk line fibers or wires (not shown) to branch line jacks, which interface with branch line connectors, such as branch line connector 74*a*. In this embodiment, there are four distribution cassettes that are coupled to a connector panel 65. Connector panel 65 is generally shaped as an "L" flange with slots for the distribution cassettes on one leg of the "L" and door hinges 67*a*–67*d* attached to the other leg of the "L."

Figure 4A:
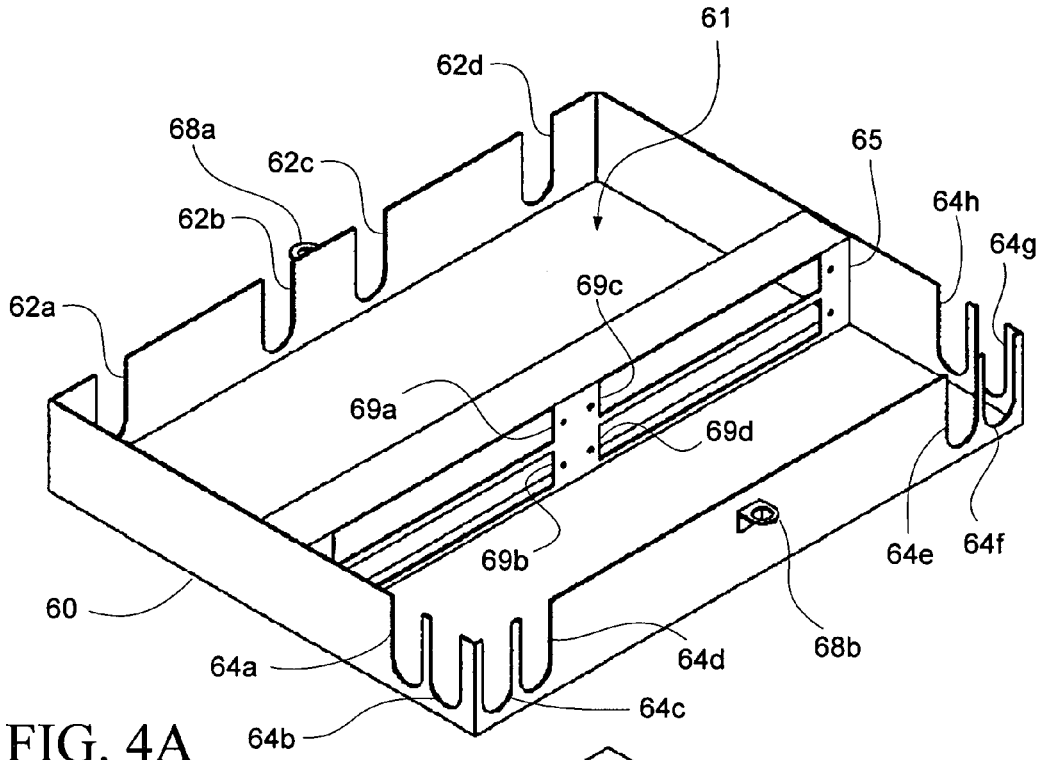
FIG. 4A is an isometric view of the double height concealed distribution box with its doors removed and no distribution cassettes or communication cables installed.

FIG. 4A is an isometric view of the double height concealed distribution box with its doors removed and no distribution cassettes or communication cables installed. This distribution box and other embodiments are generally formed as multi-sided housing 60 surrounding a cavity 61 within which distribution cassettes, cable connectors, and cable ends can be installed. At least a portion of one side of the housing is open. A door enables access to cavity 61. The housing, doors, and other components can be formed of metal, plastic, wood, composites, or other materials.

One or more trunk openings, such as trunk openings 62*a*–62*d*, are formed or cut into housing 60. The trunk openings are sized to allow the diameter of one or more trunk lines to fit in a trunk opening. However, the trunk openings are limited in size and/or positioned such that an end of a trunk line within the distribution box can not be accessed when the doors are closed. This can be accomplished by sizing the trunk opening smaller than a trunk line connector at the end of the trunk line within the distribution box. Alternatively, or in addition, the trunk opening can be offset, or otherwise located at a position that prevents access to the end of the trunk line through the trunk opening with a conventional tool. As a further security measure and/or to assist in cable routing, the trunk lines can be connected to a cassette at an angle, such as the angled corners shown in FIG. 3.

Similarly, one or more branch openings, such as branch openings 64*a*–64*h* are formed or cut into housing 60. The branch openings are also sized and/or positioned such that an end of a branch line within the distribution box can not be accessed when the doors are closed.

Attached to housing 60 within cavity 61 is connector panel 65. One or more slots, such as slots 69*a*–69*d* are formed or cut in one leg of connector panel 65. The slots can be used to secure distribution cassettes and/or to install individual connectors. Some or all of the connectors on the trunk lines and branch lines can be keyed with predefined slots, holes, pins, and/or other configurations to ensure that they couple only to mating jacks on the distribution cassettes and/or on individual jacks installed in connector panel 65.

Also formed in or attached to housing 60 is a locking means. Housing 60 illustrates lock flanges 68*a* and 68*b*, which include a hole through which a padlock can be inserted to lock the doors.

Figure 4B:
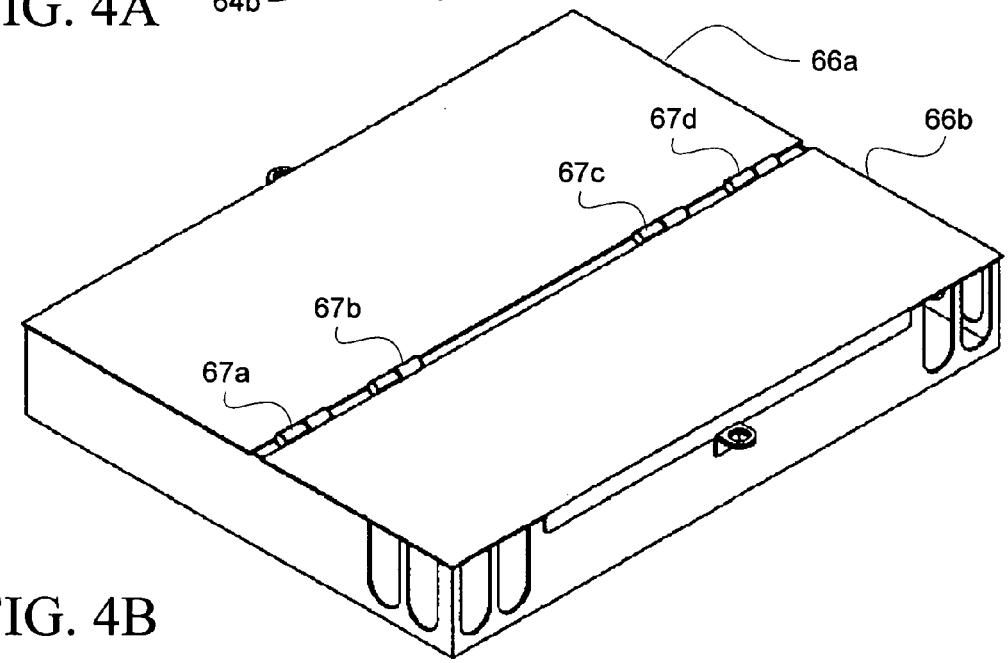
FIG. 4B an isometric view of the double height concealed distribution box with its doors 66*a* and 66*b* installed and closed.

FIG. 4B an isometric view of the double height concealed distribution box with its doors 66*a* and 66*b* installed and closed. In this embodiment, the doors are coupled with hinge pins (not shown) to hinges 67*a*–67*d*, which are attached to the connector panel inside the housing. Other closure means are possible. For example, a door could pivot about a vertical pin, such that the door remains in the same plane as it rotates open about the vertical pin. Another example includes a door that slides in grooves formed near the edges of the housing.

Figure 5A:
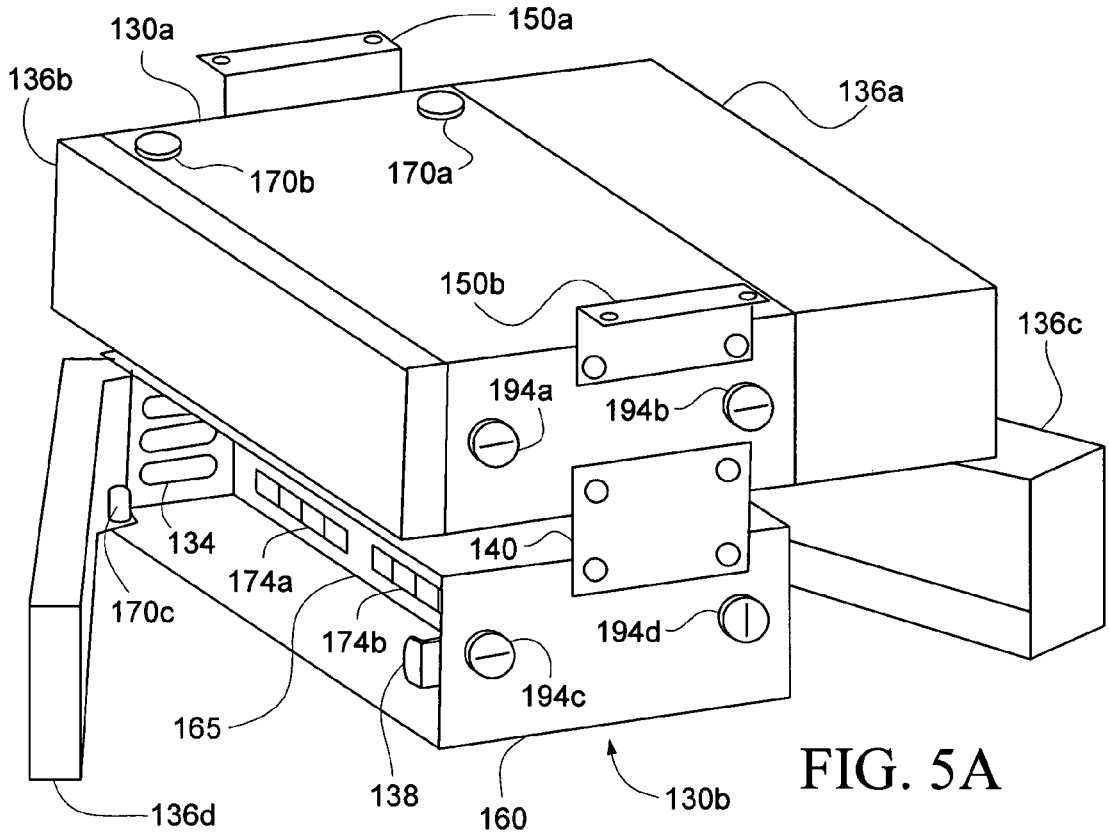
FIG. 5A is an isometric view of side-access concealed distribution boxes.

FIG. 5A is an isometric view of side-access concealed distribution boxes 130*a* and 130*b*. These concealed distribution boxes can be stacked together, such as by bracket 140, for installation in a ceiling space, a high floor space, a storage closet, or other concealed area. Bracket 140 can include threaded holes that do not to all the way through bracket 140. Fasteners can then be installed from within the distribution boxes through aligned holes in the distribution boxes to bracket 140, so that the fasteners are not accessible when the distribution boxes are locked shut. Alternatively, bracket 140 can be riveted to each distribution box or attached in other conventional ways. Flanges 150*a* and 150*b* can be used to secure one or more concealed distribution boxes to a support surface. Each side-access concealed distribution box includes at least one side door, such as doors 136*a*–136*d*. The doors can be sized according to the size of cable connectors. For instance, the doors may be lager for metallic cables than for fiber optic cables. The doors can be opened and closed by rotation about pins, such as pins 170*a*–170*c*. The pins are accessible only from the inside of the boxes. Alternative door mechanisms are possible, such as rotating the doors about hinges attached to any edge of a door opening. The doors are secured in a closed position by locking mechanisms, such as key locks 194*a*–194*d*. Each lock can be keyed differently. The different keying can be done individually or by security classification (e.g., top secret classification versus secret classification), or both. A key lock can control a latch mechanism 138 that engages with a latch bracket (not shown) on the inside of a door. Other locking mechanisms include pad locks, combination locks, and the like. Distribution cassettes (not shown) can be mounted to a connector panel 165 to provide sets of distribution jacks 174*a* and 174*b*. Branch lines (not shown) can be routed from corresponding jacks through an opening, such as a branch line slot 134, in a housing 160.

Figure 5B:
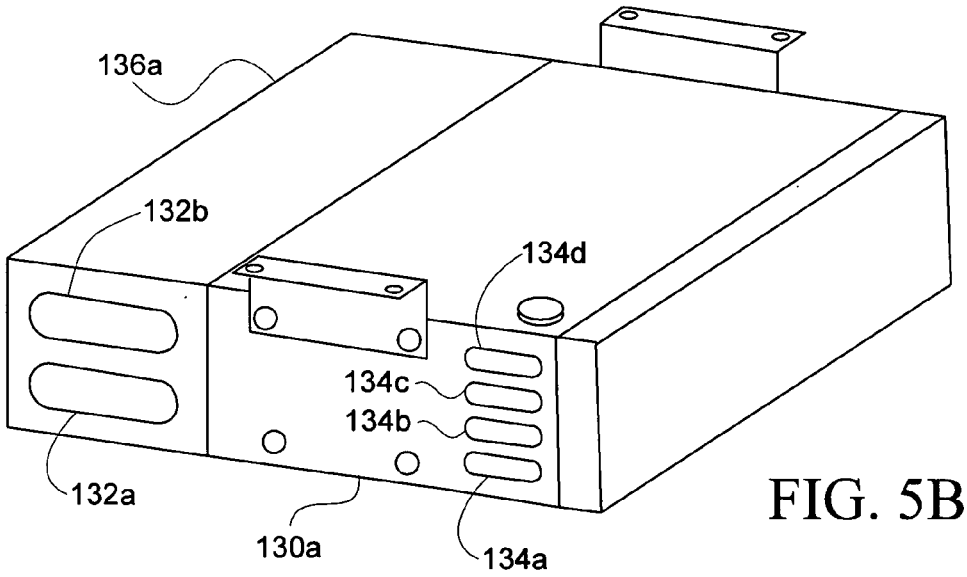
FIG. 5B is an isometric view of a rear portion of side-access concealed distribution box.

FIG. 5B is an isometric view of a rear portion of side-access concealed distribution box 130*a*. Branch line slots 134*a*–134*d* are illustrated relative to trunk line slots 132*a* and 132*b*, which form openings through door 136*a*. The trunk line openings and can be formed through the housing. However ,locating the trunk line openings in the door can provide a little more room to accommodate trunk line connectors and a bend in the trunk lines. The trunk line connectors are coupled to distribution cassettes within the box housing for distribution by corresponding branch lines. Both the trunk line slots and branch line slots are sized to prevent a person from accessing a connector within the box.

Figure 6A:
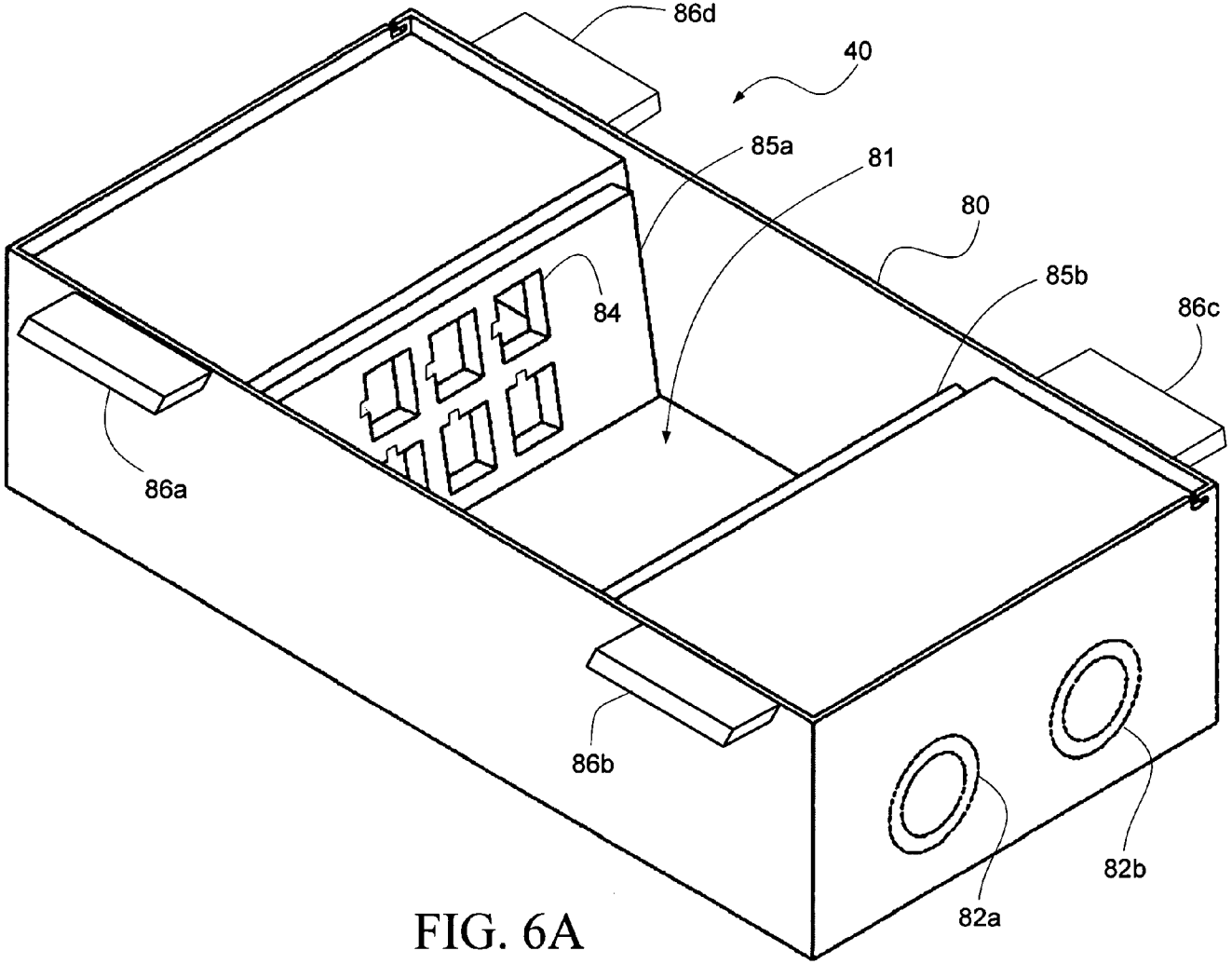
FIG. 6A is an isometric view of an integrated distribution box with its cover and door removed.

FIG. 6A is an isometric view of an integrated distribution box 40 with its cover and door removed. Integrated distribution box 40 includes a housing 80 that is also generally formed as a multi-sided box to form a cavity 81. Housing 80 includes trunk openings, such as trunk openings 82*a* and 82*b*. In this embodiment, the trunk openings are circular holes within a surface of housing 80, which would be concealed by a floor or ceiling tile. However, the housing generally extends through a floor or ceiling tile. Support flanges 86*a*–86*d* can be attached to housing 80 to help support a floor or ceiling tile.

Within cavity 81, one or more connector panels, such as connector panels 85*a* and 85*b*, are attached to housing 80. One or more distribution cassettes can be installed in the connector panels. Alternatively, or in addition, branch jacks, such as branch jack 84, can be installed in the connector panels. Branch line connectors can then be coupled to the distribution cassettes and/or branch jacks. The branch line connectors and mating jacks can be keyed, color coded, and/or otherwise configured to ensure that intended connections are made.

Figure 6B:
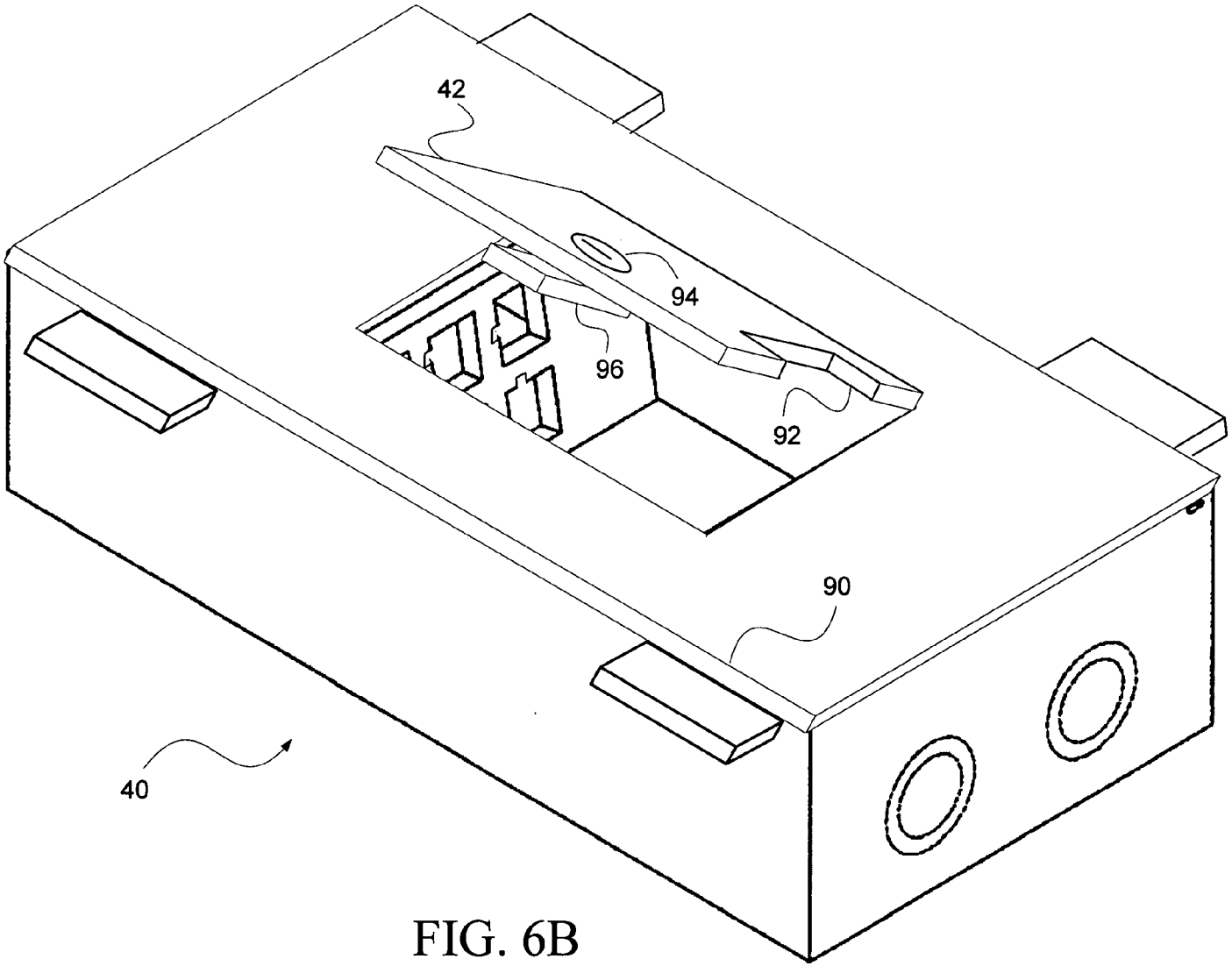
FIG. 6B is an isometric view of an integrated distribution box with its cover and door installed.

FIG. 6B is an isometric view of an integrated distribution box 40 with its cover 90 and door 42 installed. Door 42 includes one or more slots, such as a slot 92, that are large enough to allow cables to pass through, but small enough to prevent cable connectors from passing through. Door 42 also includes a locking mechanism. For instance, a key lock 94 can control a flange 96 to lock door 42. Other locking mechanisms include a deadbolt, a pin, and the like.

Figure 7:
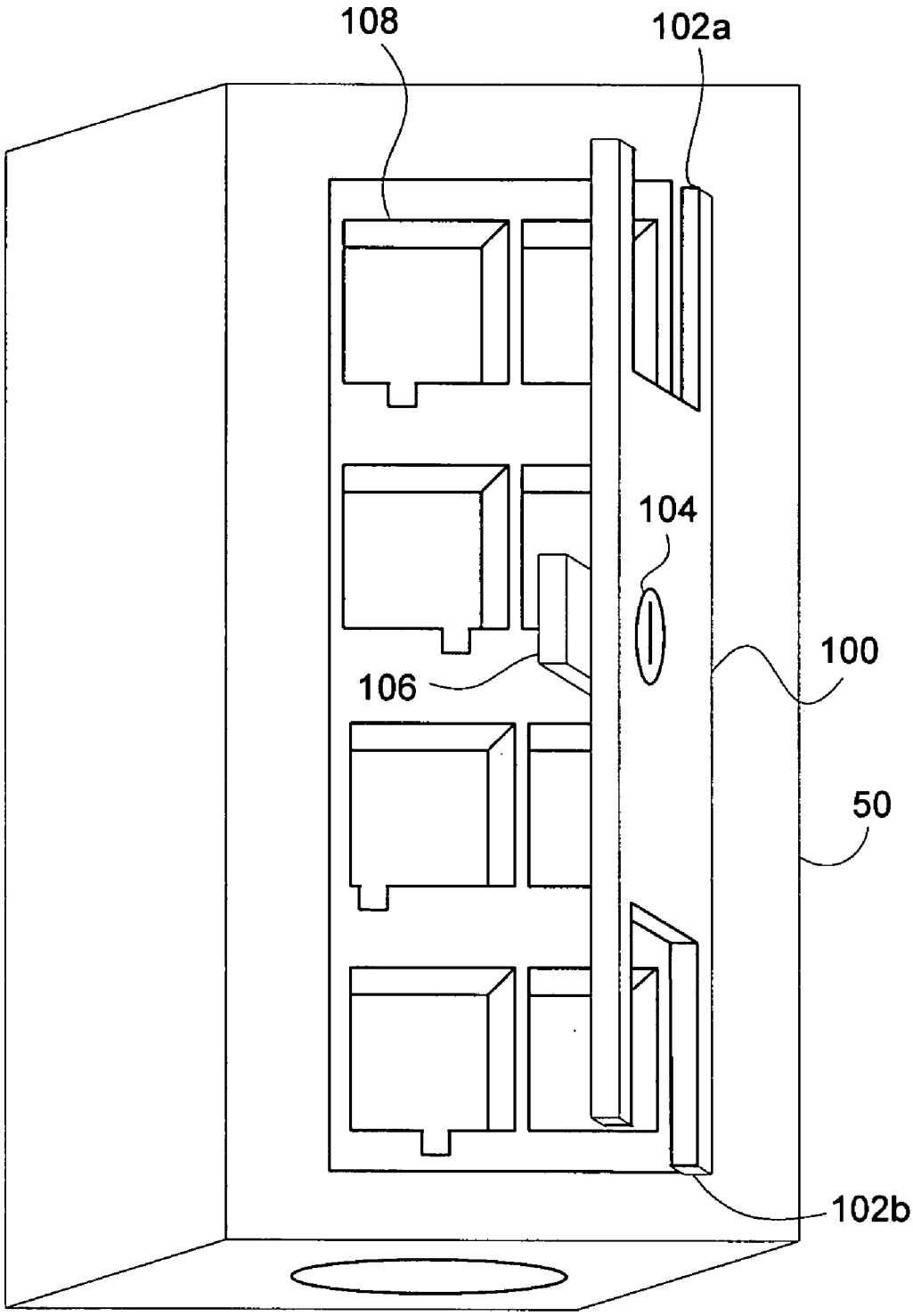
FIG. 7 is an isometric view of a lockable wall outlet.

FIG. 7 is an isometric view of lockable wall outlet 50, which is configured similar to the integrated distribution box. Lockable wall outlet 50 includes a door 100 that has one or more slots, such as slots 102*a* and 102*b*, that are large enough to allow cables to pass through, but small enough to prevent cable connectors from passing through. Door 100 also includes a locking mechanism, such as a key lock 104 and a corresponding flange 106. Other doors and locking mechanisms can be used to prevent access to cable connectors that are coupled to jacks within a cavity of the lockable wall outlet, such as jack 108. Lockable wall outlet 50 can also be used as a furniture outlet, such as furniture outlet 56 shown in FIG. 1.

FIG. 8A is a top view of a security fastener 110 for attaching a floor tile to a floor support and/or for attaching other components to other supports and/or to each other. FIG. 8B is a top view of a security fastener 110. Security fastener 110 is illustrated as a screw, however, other embodiments include, a bolt, a knob, a latching device, and the like. A head 112 of security fastener 110 includes recessed holes 114*a*–114*c* positioned in a triangular pattern. A corresponding tool (not shown) includes pins arranged in a pattern that matches recessed holes 114*a*–114*c*. The pins of the tool are inserted into recessed holes 114*a*–114*c*, and the tool is rotated in a manner similar to a screwdriver. However, the tool is not a conventional flat head screwdriver, phillips head screwdriver, alien wrench, socket wrench, or other conventional tool. Instead, the tool is specially designed and not readily available, making security fastener 110 difficult to remove.

The above specification, examples, and data provide a complete description of the manufacture and use of the composition of the invention. For example, the secure cabling system can be installed in mobile structures and/or vehicles that include a removable floor, ceiling, wall, or other surface. Alternatively, the secure cabling system can be implemented within furniture. Since many embodiments of the invention can be made without departing from the spirit and scope of the invention, the invention resides in the claims hereinafter appended.

What is claimed as new and desired to be protected by Letters Patent of the United States is:

1. A cable enclosure, comprising:

a housing forming an internal cavity that is enclosed by the housing, except that the housing includes a first opening through which a diameter of a communication cable can pass, but through which a cable connector can not pass, and except that the housing includes a second opening through which a cable connector can pass, wherein the housing is dimensioned to fit between a fixed surface of a structure and a removable surface of the structure;

a connector panel within the internal cavity that prevents access to the first opening from the second opening;

a distribution cassette removably coupled to the connector panel, wherein the distribution cassette includes a keyed trunk jack located between the connector panel and the first opening, and wherein the distribution cassette includes at least one keyed branch jack located between the connector panel and the second opening;

a door movably coupled to the housing and enabling selective access to the internal cavity through the second opening; and a lock coupled to the housing and the door, preventing the door from opening to enable access to the internal cavity.

2. The cable enclosure of claim 1, further comprising a hinge that couples the door to the housing.

3. The cable enclosure of claim 1, wherein the removable surface of the structure comprises one of a suspended ceiling tile and a raised floor tile.

4. The cable enclosure of claim 1, further comprising a removable top that is removably coupled to the housing and covers the second opening, the door movably connected to the removable top, which couples the door to the housing.

5. The cable enclosure of claim 1, further dimensioned to fit within an orifice in the removable surface of the structure.

6. The cable enclosure of claim 5, further comprising a flange to support the removable surface of the structure.

7. A cable enclosure, comprising:

a housing forming an internal cavity that is enclosed by the housing on all sides except at least one open side, wherein the housing is dimensioned to fit between a fixed surface of a structure and a removable surface of the structure;

a connector panel within the internal cavity;

a distribution cassette removably coupled to the connector panel, wherein the distribution cassette includes a trunk jack located between the connector panel and a side of the housing such that the trunk jack is not accessible from the open side, and wherein the distribution cassette includes at least one keyed branch jack located between the connector panel and the open side;

at least one door movably coupled to the housing and enabling selective access to the internal cavity through the at least one open side; and a lock coupled to the housing and the at least one door, preventing the at least one door from opening to enable access to the internal cavity.

* * * * *